United States Patent [19]

Joner et al.

[11] Patent Number: 5,056,408

[45] Date of Patent: Oct. 15, 1991

[54] SELF-RETRACTING, DRAG-FREE LUG FOR BOMBS

[75] Inventors: Bruno Joner, Huntsville, Ala.; John W. Williams, Bellevue, Wash.

[73] Assignee: TechTeam, Inc., Huntsville, Ala.

[21] Appl. No.: 560,802

[22] Filed: Jul. 31, 1990

[51] Int. Cl.[5] ..... B64D 1/04; F41F 5/00

[52] U.S. Cl. ..... 89/1.51; 89/1.819; 102/382

[58] Field of Search ..... 89/1.819, 1.58, 1.51; 102/382

[56] References Cited

U.S. PATENT DOCUMENTS

| | | | |
|---|---|---|---|
| 2,836,117 | 5/1958 | Lankford | 102/382 |
| 3,153,580 | 10/1964 | Kongelbeck | 89/1.819 |
| 3,195,406 | 7/1965 | Toomey | 89/1.819 |
| 3,379,131 | 4/1968 | Webb | 89/1.51 |
| 3,967,529 | 7/1976 | Ingle et al. | 89/1.58 |
| 4,170,923 | 10/1979 | Kilmer | 89/1.819 |
| 4,392,411 | 7/1983 | Minkler | 89/1.819 |
| 4,842,218 | 6/1989 | Groutage et al. | 89/1.51 |

*Primary Examiner*—David H. Brown

*Attorney, Agent, or Firm*—Phillips & Beumer

[57] ABSTRACT

A self-retracting bomb suspension lug assembly for being releasably supported by a hook or the like of an airplane bomb rack. The lug is mounted within a housing for axial movement and has an outer surface conforming to the shape of the bomb so as to eliminate aerodynamic drag when the bomb is released. Springs, such as a stack of Belleville springs, are disposed for biasing the lug inward when the bomb is released and the weight of the bomb no longer bears on the lug. Finger springs and pawls engagable with a groove in the bottom surface of the lug are provided to maintain the lug in partially extended loading position wherein the top of the lug is accessible for being grasped. To cock the lug, it is moved slightly inward against the force of the lug biasing spring, and the finger springs are forced radially inward to engage the groove. Upon grasping of the top of the lug, the weight of the bomb forces it to become fully extended, releasing the pawls from the grooves and clearing a downward path for full retraction of the lug when the weight of the bomb is released.

13 Claims, 3 Drawing Sheets

SELF-RETRACTING, DRAG-FREE LUG FOR BOMBS

ORIGIN OF THE INVENTION

This invention was made with government support under a Small Business Innovation Research (SBIR) program contract awarded by the Department of the Air Force. The government has certain rights in this invention.

FIELD OF THE INVENTION

This invention relates generally to devices for launching bombs from aircraft and more particularly to suspension lugs for bombs.

BACKGROUND OF THE INVENTION

The means used for attachment of an aerial bomb to a bomb rack and its release mechanism has generally remained the same since commencement of aerial bombardment. This suspension attachment has taken the form of a fixed lug screwed into the body or shell of the bomb and projecting outward from the bomb surface. When the concept of a fixed lug was introduced, aerodynamic drag of the lug on the bomb was not an important factor. The launch speed of the bomb was low, and bomb sight accuracy was not well developed. A deviation in the path of the free-falling bomb due to the unsymmetrical drag force created by suspension lugs projecting outward from the surface of the bomb was not considered detrimental to the mission under such conditions.

Drag effects of suspension lugs have assumed more importance with the higher launching speeds of present day high-performance aircraft and sophisticated high-precision bombing systems that make use of improved bomb sights with the capability to compensate for conditions which can affect the path of the falling bomb by calculating the exact moment for release responsive to those conditions. To take full advantage of precision bombing technology, a need exits to reduce or eliminate unsymmetrical drag forces produced by conventional suspension lugs.

Various retractable lug devices for missiles are disclosed in prior art patents. A prior art patent, U.S. Pat. No. 3,967,529, issued July 6, 1976, to Ingle et al., shows a missile wherein supporting lugs are retracted into the body of the missile after launch by action of biasing springs. This device is not applicable to bomb lugs in that it depends upon the action of launcher rails that remain with the launch platform. U.S. Pat. No. 4,170,923, issued Oct. 16, 1979, to Kilmer, also shows an assembly for retracting missile launch lugs out of the airstream after launch, but this device would likewise not be adaptable for bomb suspension lugs.

SUMMARY OF THE INVENTION

The present invention is directed to a self-retracting bomb suspension lug assembly for releasable engagement with support means on an airplane. The assembly includes a housing adapted to be fixedly engaged in the body of a bomb and a lug mounted in the housing for movement in an axial direction with respect to the surface of the bomb. The lug is movable from a loading position wherein it projects partially outward from the bomb surface to a suspended positioned in which the full weight of the bomb bears down on the lug to a closed, free-falling position wherein the lug is fully retracted and its outer surface conforms to the shape of the bomb, thus eliminating lug-induced drag. The housing may be in the form of a generally cylindrical member fitted into a well in the bomb, with the external surface of the housing conforming to the surface contour of the bomb outside the well. The lug is adapted to be movable axially within an opening in the housing generally in the manner of a piston moving within a cylinder. A spring means is provided for urging the lug downward to the fully retracted position upon release of the bomb, action of the spring being restrained prior to release by the force of dead weight of the bomb. Cocking means for securing the lug at an intermediate position to enable loading is also provided, the cocking means being arranged for disengagement when the lug is engaged by a support hook so that the full weight of the bomb bears on the lug. The outer surface of the lug is shaped so that when fully retracted into the housing, it conforms to the contour of its surrounding housing. Thus, a continuously contoured surface between the bomb housing and lugs is provided.

It is, therefore, an object of this invention to provide a suspension lug for bombs that is retractable to a position conforming to the surface contour of the bomb.

Another object is to provide a bomb suspension lug that avoids producing aerodynamic drag when the bomb is dropped.

Yet another object is to provide a suspension lug that is self-retracting upon release of the bomb.

Other objects and advantages of the invention will be apparent from the following detailed description.

DESCRIPTION OF THE PREFERRED EMBODIMENT

Figure 1:
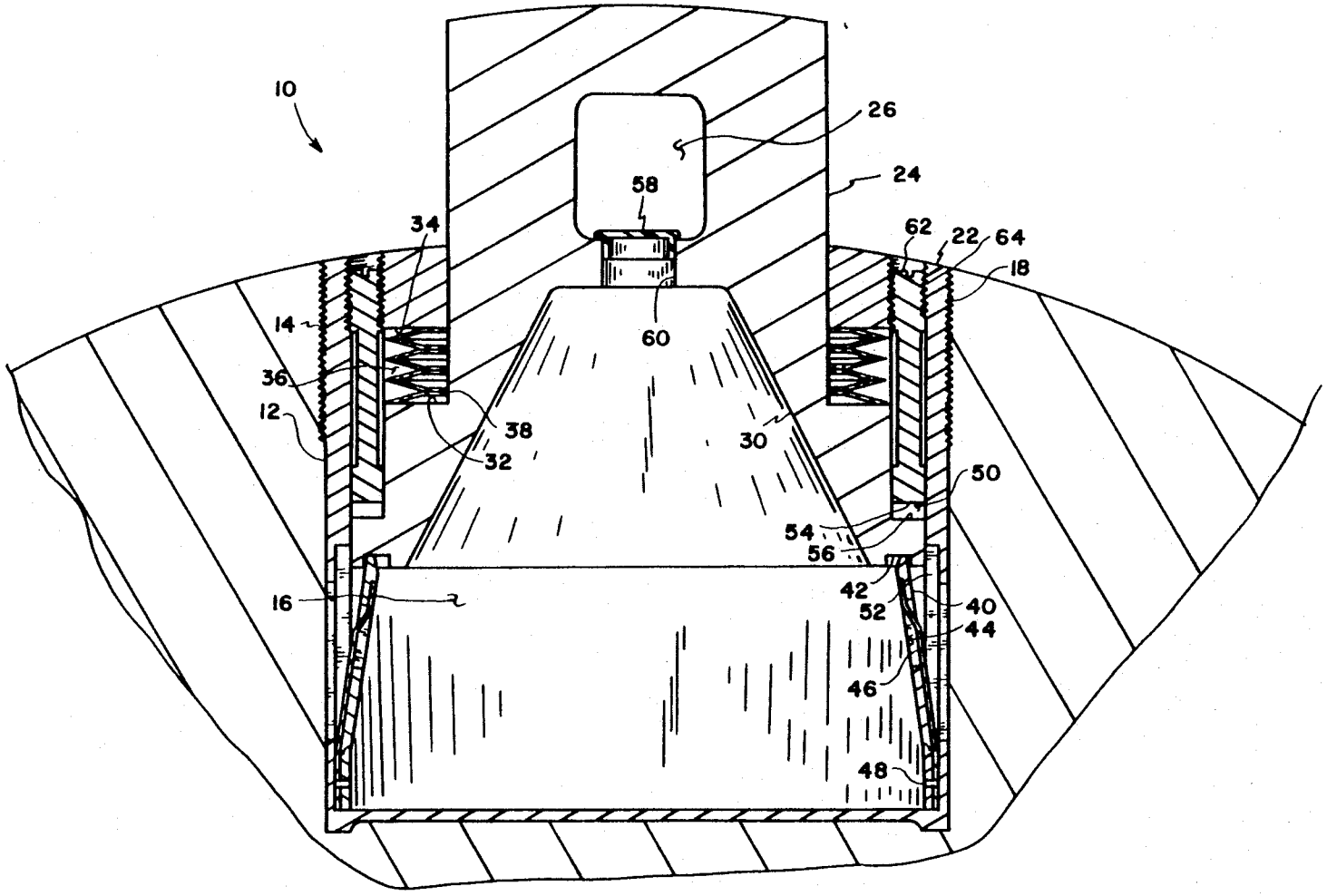
FIG. 1 is a sectional view of a lug assembly embodying the invention.

Referring to FIG. 1 of the drawings, there is shown a suspension lug assembly 10. The assembly includes a generally cylindrical housing 12 having external threads 14 at its upper end for securing it in a cylindrical well 16 in the bomb, the well having mating external threads 18 at its top end. The bomb case 20 adjacent to the well has an arcuate contour, and the outer surface 22 of the housing is shaped to conform to this contour so as to avoid providing aerodynamic drag.

Lug 24 is disposed in the housing so as to be movable axially to three positions. The position shown is an intermediate or loading position which enables the lug to be grasped through opening 26 spaced apart from its outer end by a releasable support means such as a hook (not shown) carried by an airplane. Upon unscrewing axially disposed set screws 62 and the lug being grasped so that the dead weight of the bomb bears on the lug, the lug is movable to a fully extended position, the weight of the bomb overcoming the means to use to retain the lug in the loading position. When the bomb is released, the lug is movable to a fully retracted position by spring biasing means. In this position, upper surface 22 of the lug, which is shaped to conform to the contour of the housing and bomb cases, is retracted and disposed flush with the housing so as to not leave any protrusion outside the bomb contour. The lug has a circular body portion 30 that operates in the housing in the manner of a piston in a cylinder. A circumferential shoulder 32 forms a ledge spaced apart axially from bottom surface 34 of the underside of the innermost portion of the housing, providing a space 36 for compression spring 38, preferably in the form of a stacked array of Belleville springs. The springs operate against ledge 32 and bottom surface 34, biasing the lug downward when the upward pull resulting from the weight of the bomb is released.

A mechanism for cocking the lug in an intermediate position allowing access to hole 26 by a supporting hook is provided by pawls 40 that are engageable in a groove 42 located on the bottom surface of the lug and spaced apart from its edge. The pawls ride in slots 44 of finger springs 46, which are secured to the lower end of the housing by means of pins 48. The finger springs are biased outwardly so that when the weight of the bomb is applied, and the lug moves upward as allowed by space 50 between the lug and housing, the pawls are disengaged from the groove, and they snap outwardly into recess 52, leaving the bottom end of the lug free to move downward when the bomb is released. Upward movement of the lug when engaged by a supporting hook is limited by contact of the surfaces defining space 50, that is, surface 54 of the housing and surface 56 of the lug. Axially disposed set screws 62 may be placed in threaded aperture 64 in order to provide for on-ground handling of the bomb by lifting it by its lugs without causing full extension of the lugs for automatic retraction at release.

An aperture 60 may be located in the top of the lug body so as to enable air to escape when the lug retracts downward upon release of the bomb. Removable cover 58 in the form of a plug that fits in the aperture provides for protection of the lug interior from dust, moisture, and the like during storage.

Figure 2:
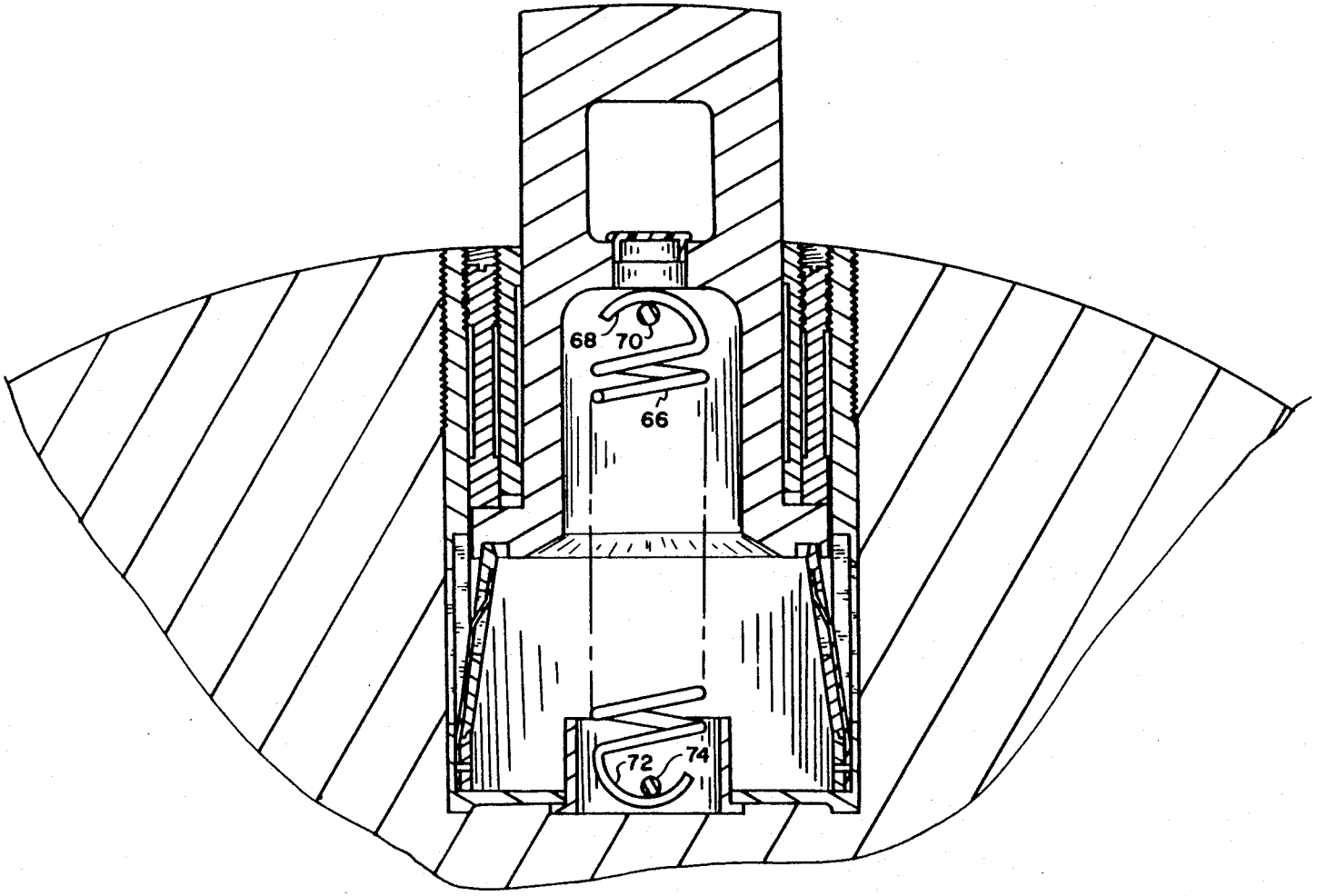
FIG. 2 is a sectional view of another embodiment of a lug assembly.

FIG. 2 shows an alternate embodiment wherein spring biasing of the lug inwardly into the base of the housing upon dropping the bomb is provided by a tension spring 66 operably connected at its top end 68 to pin 70 securd to the lug and at its bottom end 72 to pin 74 secured to the base of the housing. The remaining features in this embodiment may be the same as described with respect to FIG. 1.

Figure 3:
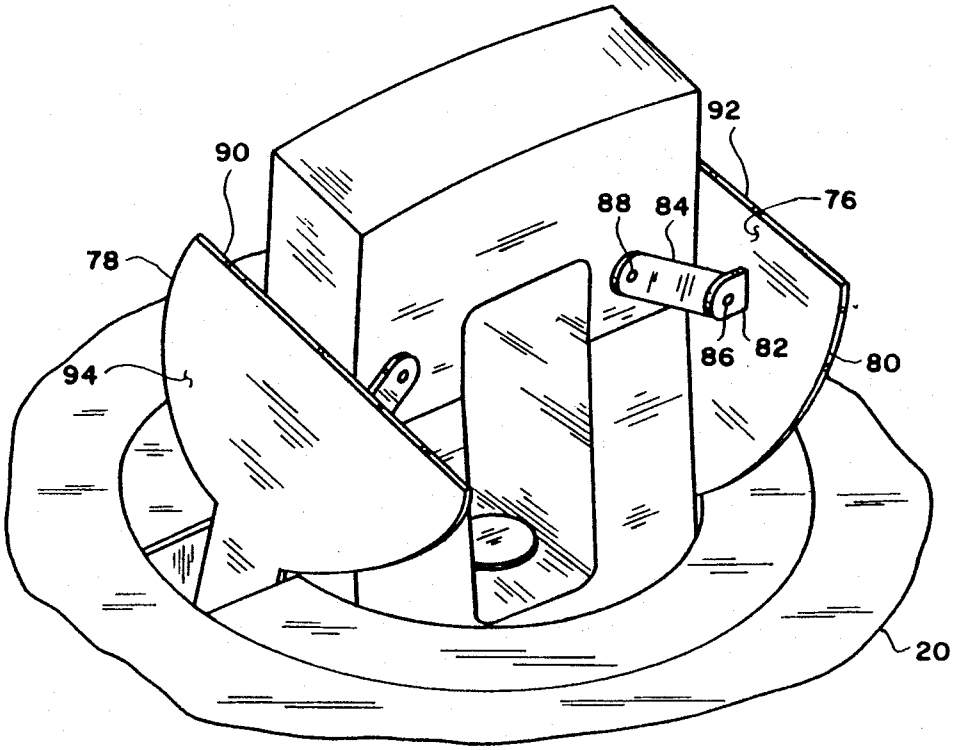
FIG. 3 is a pictorial view showing a retractable clamshell cover for a suspension lug.

FIG. 3 shows a retractable mechanism 76 that may be used to cover the lug and housing when the lug is in fully retracted position. The mechanism includes hinged clamshell halves 78 and 80 movably secured near their upper ends to a side of the lug by tabs 82 on the underside of the clamshell halves and linkage bars 84 connected to the tabs and to the lug by pins 86 and 88. Upon movement of the lug to fully retracted position, the linkage bars move inward, causing the clamshell halves to be moved together so that their forward edges 90 and 92 are in side-by-side alignment. Outer surfaces 94 of the halves in this embodiment are adapted to conform to the surface contour 20 of the adjacent bomb surface.

Figure 4:
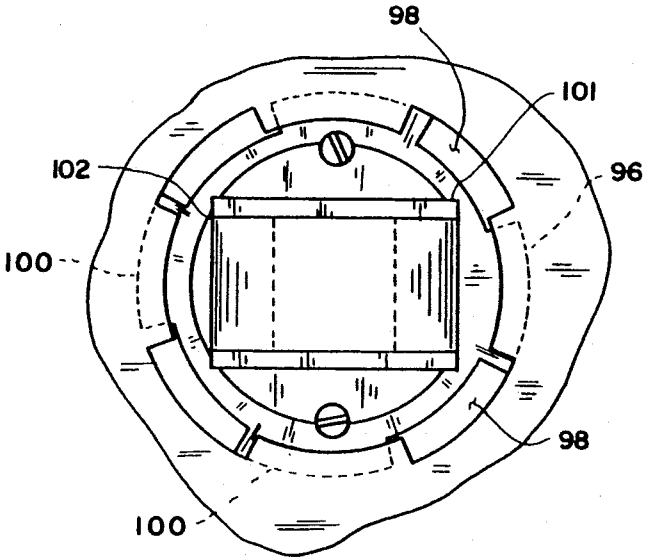
FIG. 4 is a view from above of an installed lug assembly having an alternative, quarter-turn attachment mechanism and a rectangular, keyed lug body.

An alternate structure for securing the housing and lug assembly within the well of a bomb is shown in FIG. 4. Instead of using a large number of mating threads on the housing and bomb well as shown in FIG. 1, a "quarter-turn" connecting mechanism is provided. In this embodiment, the bomb well 96 has a plurality of generally circumferentially arranged plates 98 disposed for connection with mating plates 100 on the lug housing. The plates are ramped axially so as to become firmly wedged and locked together when the housing is rotated within the well. Only a small portion of a rotation such as one-quarter turn is required to secure the lug housing within the well using this embodiment. This provides for easier and more rapid installation of the housing in the well. The embodiment shown in FIG. 4 also has a rectangular lug body with corner edges 101 thereof moving in vertically disposed slots 102 in the housing. This keying arrangment prevents the lug from rotating within the housing and thus automatically aligns the lug for hook-up in a bomb rack hook. The same keying arrangement can also be applied to the embodiment shown in FIG. 1. In addition, other keying arrangements may be used.

The above-described embodiments are merely illustrative, and numerous variations and modifications may be employed without departing from the scope of the invention, which is limited only as indicated by the appended claims.

We claim:

1. A self-retracting suspension lug assembly for an aerial bomb having a well for receiving said assembly and an outer surface adjacent thereto comprising:

a housing adapted to be secured within said well and having an outer surface shaped to conform to said bomb surface;

a lug having an externally graspable support member and being disposed within said housing for movement across the outer surface thereof from a loading position wherein said graspable support member is accessible to grasping means to a fully extended position wherein the weight of the bomb bears fully on said support member to a fully retracted position upon release of the bomb;

said lug having an upper surface that conforms to the shape of said housing surface and the adjacent bomb surface so that when the lug is fully retracted upon release of the bomb, aerodynamic drag resulting from the presence of the lug is minimized;

spring means biasing said lug inward and providing retracting movement when the bomb is dropped; and cocking means for holding said lug in graspable loading position until the full weight of the bomb is applied to said support member.

2. An assembly as defined in claim 1 wherein said lug has a rectangularly shaped body with corner edges thereof adapted to be keyed with mating slots in said housing.

3. An assembly as defined in claim 1 including a pair of hinged clamshell cover halves movably linked to said lug for being brought together when said lug is fully reacted, thereby covering said lug.

4. An assembly as defined in claim 1 including means for fixedly securing said housing in said well.

5. An assembly as defined in claim 4 wherein said housing and said well have generally cylindrical shapes, and said means for fixedly securing said housing in said wells comprises mating threads on the inner surface of a side wall of the well and on the outer surface of a side wall of the housing.

6. An assembly as defined in claim 4 wherein said housing and said well have generally cylindrical shapes, and said means for securing said housing in said well comprises a plurality of mating plates on the side walls of said well and said housing and adapted to be wedged into firm contact with one another upon rotation of said housing.

7. An assembly as defined in claim 4 wherein said lug has a rectangularly shaped body with corner edges thereof adapted to be keyed with mating slots in said housing.

8. An assembly as defined in claim 1 wherein said lug has an upper surface in said housing matable with a lower surface of the housing for limiting outward movement of the lug, and said surfaces may be moved apart from one another so as to enable engagment of said cocking means.

9. An assembly as defined in claim 8 wherein said cocking means comprises at least one spring biased member engageable with said lug and adapted to be disengaged when tthe full weight of said bomb bears on said support member, said spring biased member being biased to be removed from the downward path of said lug when disengaged.

10. An assembly as defined in claim 9 wherein said housing has a generally hollow cylindrical shape, and said lug has a piston-like shape with a base portion thereof mating with the inner wall of said housing for longitudinal movement therein.

11. An assembly as defined in claim 10 including a groove in the bottom of the base portion of said lug spaced apart from the lug edge for receiving said spring member, said spring member being disengagable from said groove upon outward movement of said lug.

12. An assembly as defined in claim 11 wherein said spring bias member includes at least one finger spring secured to the lower end of said housing and biased radially outward and a pawl operably connected to said spring bias member for engaging said groove.

13. An assembly as defined in claim 12 wherein said spring means biasing said lug inwardly comprises a stacked array of Belleville springs.

* * * * *